US011019940B2

(12) United States Patent
Babikian et al.

(10) Patent No.: US 11,019,940 B2
(45) Date of Patent: Jun. 1, 2021

(54) BABY CHANGING STATION

(71) Applicant: BOBRICK WASHROOM EQUIPMENT, INC., North Hollywood, CA (US)

(72) Inventors: Dikran Babikian, Glendale, CA (US); Raffi Mekhitarian, Shadow Hills, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 592 days.

(21) Appl. No.: 15/398,581

(22) Filed: Jan. 4, 2017

(65) Prior Publication Data

US 2017/0196372 A1 Jul. 13, 2017

Related U.S. Application Data

(60) Provisional application No. 62/370,539, filed on Aug. 3, 2016, provisional application No. 62/276,759, filed on Jan. 8, 2016.

(51) Int. Cl.
*A47C 5/00* (2006.01)
*A47D 5/00* (2006.01)

(52) U.S. Cl.
CPC ..... *A47D 5/003* (2013.01); *A47D 5/006* (2013.01)

(58) Field of Classification Search
CPC ..... Y10S 5/947; A47D 5/00; A47D 5/003; A47D 5/006
See application file for complete search history.

(56) References Cited

U.S. PATENT DOCUMENTS 3,644,947 A * 2/1972 Padera ..... A47D 5/006 5/100
3,863,281 A 2/1975 Tosic
4,926,758 A * 5/1990 Lilly ..... A47B 23/001 108/115
5,446,932 A * 9/1995 Voorhis ..... A47C 17/40 5/137
5,709,155 A * 1/1998 Terracciano ..... A47C 7/70 108/152
5,906,015 A * 5/1999 Hilger ..... A47D 5/003 5/133

(Continued)

FOREIGN PATENT DOCUMENTS

DE 7304709 8/1973
JP 2011 172708 9/2011
KR 20-0450414 10/2010

OTHER PUBLICATIONS

International Search Report and Written Opinion issued in PCT/US2017/012194, dated Apr. 12, 2017, 15 pages.

(Continued)

*Primary Examiner* — Robert G Santos
*Assistant Examiner* — Ifeolu A Adeboyejo
(74) *Attorney, Agent, or Firm* — Lewis Roca Rothgerber Christie, LLP

(57) ABSTRACT

A baby changing station includes a wall mount for mounting to wall, a bed, a first frame for pivotably mounting the bed to the wall mount in a horizontal position, and a second frame for pivotably mounting the bed to the wall mount in vertical portion.

28 Claims, 6 Drawing Sheets

(56) References Cited

U.S. PATENT DOCUMENTS 6,032,310 A * 3/2000 Helmsderfer ..... A47D 5/003 5/136
6,151,737 A * 11/2000 Henninge ..... A47C 17/40 5/136
7,395,765 B1 * 7/2008 Dorfman ..... A47B 5/00 108/42
9,345,338 B1 * 5/2016 Arch ..... A47D 5/006
2004/0078899 A1 * 4/2004 Helmsderfer ..... A47D 5/006 5/655
2004/0139543 A1 * 7/2004 Courouzos ..... A47D 5/00 4/572.1
2006/0225205 A1 * 10/2006 Troutman ..... A47D 5/00 5/93.1
2007/0157380 A1 * 7/2007 Helmsderfer ..... A47D 5/003 5/136
2008/0209632 A1 * 9/2008 Presnell ..... A47D 5/003 5/136
2010/0037396 A1 * 2/2010 Babikian ..... A47D 5/003 5/655
2011/0283455 A1 * 11/2011 Grainger ..... A47D 5/003 5/655
2012/0036634 A1 * 2/2012 Pacella ..... A47D 9/005 5/93.1
2012/0110730 A1 * 5/2012 Sousa ..... A47D 5/00 5/2.1
2013/0025049 A1 * 1/2013 McCoy ..... A47C 17/48 5/133
2014/0201920 A1 * 7/2014 Gant ..... A47D 5/006 5/655
2014/0359938 A1 * 12/2014 Burns ..... A47D 7/04 5/93.1
2014/0374305 A1 * 12/2014 Fimbrez ..... A45C 9/00 206/581
2016/0324326 A1 * 11/2016 McCoy ..... A47C 17/46
2017/0196373 A1 * 7/2017 Sclare ..... A47D 11/007

OTHER PUBLICATIONS

Invitation to Pay Additional Fees and results of partial international search issued in PCT/US2017/012194, dated Feb. 20, 2017, 5 pages.

* cited by examiner

BABY CHANGING STATION

CROSS-REFERENCE TO RELATED APPLICATIONS

This application is based and claims the benefit of U.S. Provisional Application Nos. 62/276,759, filed on Jan. 8, 2016, and 62/370,539, filed on Aug. 3, 2016, the contents of both of which are incorporated fully herein in their entirety.

BACKGROUND OF THE INVENTION

Baby changing stations are provided with either a horizontal bed or a vertical bed. Suppliers of such beds have to store both types of baby changing stations in their inventories. As such more storing space is required. Thus, a baby changing station that has a bed that can be used as both a vertical and a horizontal bed is desired.

SUMMARY OF THE INVENTION

In an example embodiment, a baby changing station is provided including a mounting section for mounting to wall, a bed, a first frame for pivotably mounting the bed to the mounting section in a horizontal position, and a second frame for pivotably mounting the bed to the mounting section in vertical portion. In another example embodiment, the bed includes a first surface defining a bed for receiving a baby, opposite a second surface and a peripheral surface extending from the first to the second surface. The peripheral surface includes a depression, and the first frame is received in the depression when mounting the bed in the horizontal position and the second frame is received in the depression when mounting the bed in the vertical position. In yet another example embodiment, each of the first and second frames includes a first section, a second section and a third section. In one example embodiment, each frame first section is identical to the frame's second section. In a further example embodiment, the third section of the first and second frames is the same third section. In yet a further example embodiment, each frame first and second section includes a portion for coupling with the mounting section. In one example embodiment, the mounting section includes a first slot for receiving the first frame first section portion, and a second slot for receiving the first frame second section portion. In another example embodiment, the mounting section includes a first slot for receiving the second frame first section portion, and a second slot for receiving the second frame second section portion. In yet another example embodiment, the mounting section further includes a third slot for receiving the first frame first section portion, and a fourth slot for receiving the first frame second section portion. In a further example embodiment, the mounting section includes a first vertical wall and a second vertical wall and when the first frame mounts the bed to the mounting section, the first frame first section portion is adjacent the first vertical wall and the first frame second section portion is adjacent the second vertical wall, and a pin penetrates each of the first frame first and second section portions and the first and second vertical walls such that the first frame with bed is pivotable about the pin. In yet a further example embodiment, when the first frame mounts the bed to the mounting section, each of the first and second section portions and the first and second vertical walls includes an opening penetrated by the pin. A first end cap is coupled to a first end of the pin and a second end cap is coupled to a second end of the pin opposite the first end, and each a cap has a dimension greater than a dimension of at least two of the openings. In another example embodiment, the mounting section includes a first vertical wall and a second vertical wall, and when the second frame mounts the bed to the mounting section, the second frame first section portion is adjacent the first vertical wall and the second frame second section portion is adjacent the second vertical wall, and a pin penetrates each of the second frame first and second section portions and the first and second vertical walls, and the second frame with bed is pivotable about the pin. In yet another example embodiment, the second frame mounts the bed to the mounting section, each of the first and second section portions and the first and second vertical walls includes an opening penetrated by said pin, and wherein a first end cap is coupled to a first end of the pin and a second end cap is coupled to a second end of the pin opposite the first end, wherein each a cap has a dimension greater than a dimension of at least two of the openings. In one example embodiment, the mounting section includes first, second, third and fourth vertical walls, and when the bed is pivotably mounted to the mounting section in the horizontal position, the first frame first section portion is adjacent the first vertical and the first frame second section portion is adjacent the second vertical wall. A pin penetrates each of the first frame first and second section portions and the first and second vertical walls, and the first frame with bed is pivotable about the pin. When the bed is pivotably mounted to the mounting section in the vertical position, the second frame first section portion is adjacent the third vertical and the second frame second section portion is adjacent the fourth vertical wall. A pin penetrates each of the second frame first and second section portions and the third and fourth vertical walls, and the second frame with bed is pivotable about the pin. In another example embodiment, each of the first, second, third and fourth vertical walls includes an opening penetrated by the pin, and a first end cap is coupled to a first end of the pin and a second end cap is coupled to a second end of the pin opposite the first end, and each a cap has a dimension greater than a dimension of at least two of the openings. In yet another example embodiment, the mounting section includes an upper wall, and the first section portion and the second section portion of each of the first and second frames when mounted on the mounting section, directly or indirectly engage the upper wall to stop pivoting of the bed relative to the mounting section. In one example embodiment, the first section portion and the second section portion of each of the first and second frames when mounted on the mounting section engages a structure connected to the upper wall to stop pivoting of the bed relative to the mounting section. In yet another example embodiment, the first section portion and the second section portion of each of the first and second frames when mounted on the mounting section directly engages the upper wall to stop pivoting of the bed relative to the mounting section. In a further example embodiment, the mounting section includes an upper wall, and the upper wall serves as a stop for stopping pivoting of the bed relative to the mounting section.

In another example embodiment a baby changing station includes a mounting section for mounting of a wall, a bed comprising a peripheral surface defining an external depression in cross-section, and a frame within the external depression pivotally coupling the bed to the mounting section.

DETAILED DESCRIPTION

Figure 1:
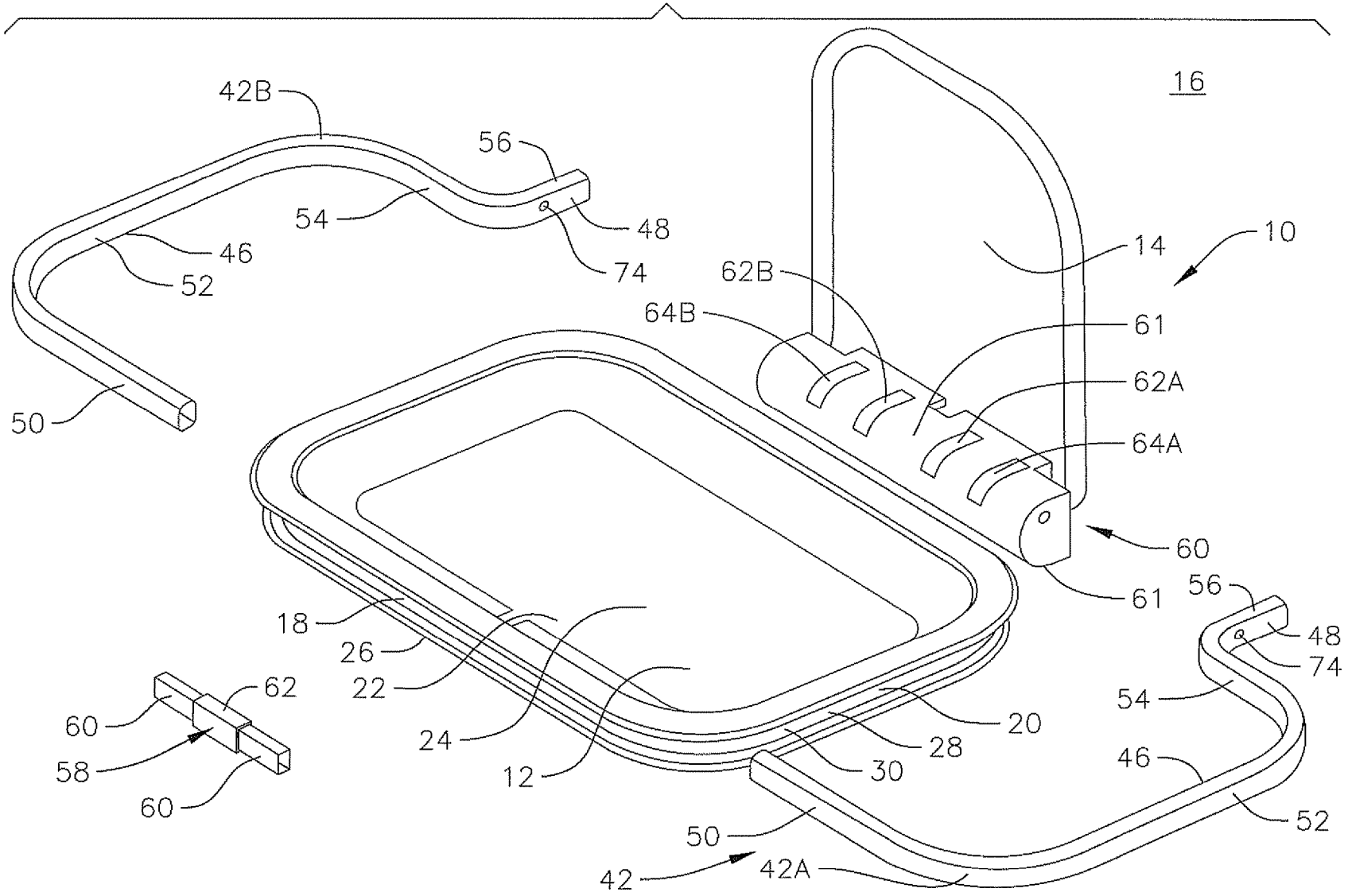
FIG. 1 is a perspective exploded view of an example embodiment baby changing station with a horizontal bed.

Baby changing stations 10 are provided, where a bed 12 may be mounted in a horizontal or a vertical position relative to a wall mount 14 of the baby changing station (FIG. 1). A baby changing station 10 includes a wall mount 14 which is a section of the baby changing station that is mounted to the wall 16. A bed or platform 12 is hingeably connected to the wall mount 14. In this regard, the bed can fold against, or over, or within, or parallel to, the wall mount to be out of the way, and can be extended (i.e., unfolded) to a position where it is relatively horizontal for accommodating a baby. A typical bed 12 is generally rectangular in shape having longer sides 18 and shorter sides 20. The bed may have rounded corners 15. A horizontally mounted bed is a bed whose longer side 18 is generally parallel to the wall 16 onto which the baby changing station wall mount is mounted, as for example shown in FIG. 1. A vertically mounted bed is a bed whose longer side 18 extends along a direction generally perpendicular to the wall 16 onto which the baby station wall mount is mounted, as for example shown in FIG. 4.

A typical bed includes an upper surface 22 which forms a depression 24 for receiving a baby to be supported. Opposite the upper surface is a lower surface 26 which is interconnected to the upper surface 22 with a peripheral surface 28. Typically, the bed is injection molded or blow molded as a single piece. In some example embodiments, it may be formed in multiple pieces. For example, it may be formed in an upper piece, including the upper surface and an upper portion of the peripheral surface, and a lower piece, including the lower surface and a lower portion of the peripheral surface. The two pieces are then connected together using known methods and techniques.

Figure 3B:
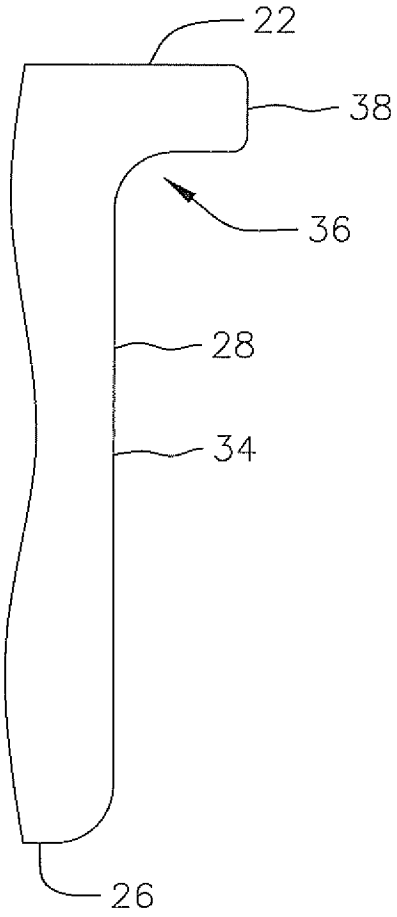
FIGS. 3A and 3B are cross-sectional views of example embodiment depressions formed on a peripheral surface of example embodiment baby changing station beds.
Figure 3A:
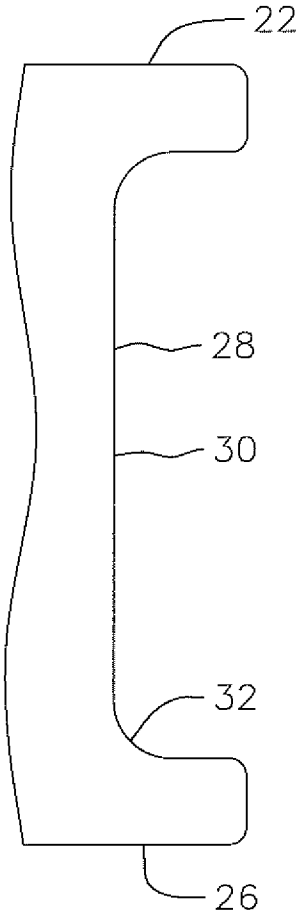

In an example embodiment, a baby changing station has a single bed 12 that can be mounted either in a vertical or a horizontal position. In an example embodiment, the bed may be formed with an annular depression 30 in the peripheral surface 28, defining a channel 32, as for example shown in FIGS. 1 and 3A. In another example embodiment, instead of a depression forming a channel, a depression 34 may be formed on the peripheral surface defining a generally upside down L-shape in cross section 36 where an upper portion 38 of the peripheral surface extends radially outward beyond a lower portion 40 of the peripheral surface, as for example shown in FIG. 3B.

Figure 2:
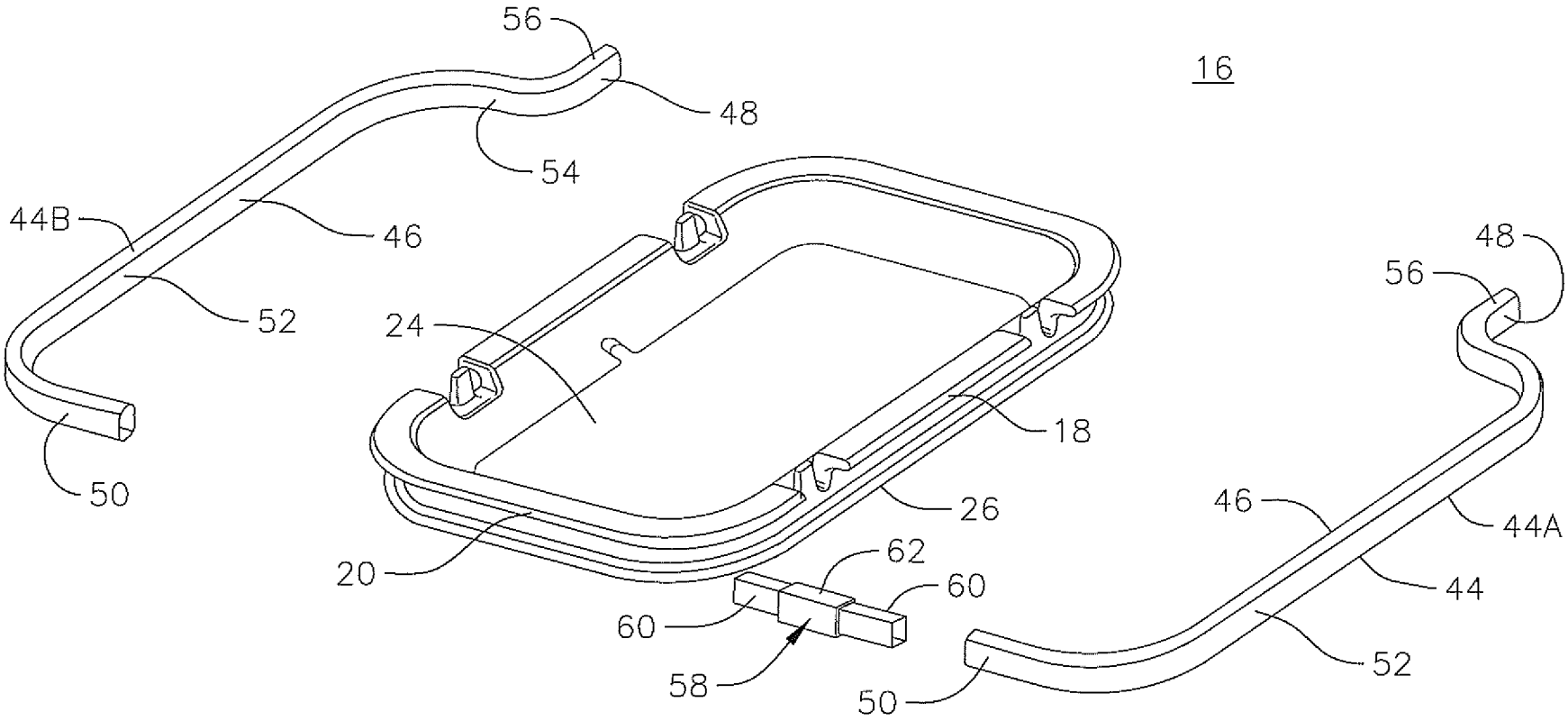
FIG. 2 is a perspective exploded view of an example embodiment bed for vertical mounting.

Two frames are provided, each for being received in the depression 30, 34. In an example embodiment, as shown in FIGS. 1 and 2, the frames are three-piece frames. One of the frames 42 allows for horizontal mounting of the bed, and the other of the frames 44 allows for vertical mounting of the bed. In an example embodiment, each frame has two frame members, i.e. a first frame member 42A and a second frame member 42B (or a first frame member 44A and a second frame member 44B) which in an example embodiment, are identical, and each of the first and second frame members defines a channel shape portion 46 defining a channel shape in cross section along a plane intersecting the entire member, and has a portion 48 extending transversally therefrom. In the example embodiment, each of the first and second frame members has a first section 50. A second section 52 extends transversally from the first section. A third section 54 extends transversally from the second section. The three sections define the channel shape portion 46. A fourth section 56 extends transversally from the third section and defines the portion 48 extending transversely from the channel shape portion 46. In the shown example embodiments, each section extends generally perpendicularly from its adjacent section. In the shown example embodiments, the first section is generally parallel to the third section. In an example embodiment, each of the first and second frame members is hollow. In an example embodiment, the channel shaped portion of each frame is complementary to the depression 30, 34 of the peripheral surface of the bed for mating with the depression.

Each frame member is received in the peripheral surface depression 30, 34 from opposite sides of the bed, respectively. A third frame member 58 interconnects the two frame members 42A and 42B (or 44A and 44B) and specifically interconnects the first section 50 of one frame member with the first section 50 of the second frame member. The third frame member 58 includes two end sections 60 extending from a middle section 62. Each of the end sections has a reduced outer surface dimensions so that it may fit within a hollow first section 50 of its corresponding first or second frame member. The outer surface geometry of each end section is complementary to the hollow inner surface geometry of its corresponding frame member first section 50. In other example embodiments, the first sections 50 of each frame member may be received within a hollow corresponding end section 60 of the third frame member.

Fasteners may be used to fasten the first sections 50 of the first and second frame members to their corresponding end section 60 of the third frame member end optionally to the peripheral surface 28 of the bed. Openings may be formed in each end section 60 of the third frame member as well as in each first section 50 of the first and second section frame members that align when the three frame members are coupled together to allow a fastener such as a screw to penetrate and fasten the third frame member to each of the first and second frame members.

In an example embodiment, the outer dimensions of the middle section 62 of the third frame member are the same as the outer dimension of the first sections of the first and second frame members, such that when the three frame members are coupled together the outer surfaces of the three members are aligned and flush or relatively flush.

In an example embodiment, the same third frame member is used to form each of the two frames for mounting the bed horizontally or vertically. In other words, the baby changing station is provided with two frames each having a first and a second frame member and a single third frame member is provided for both frames.

Figure 4:
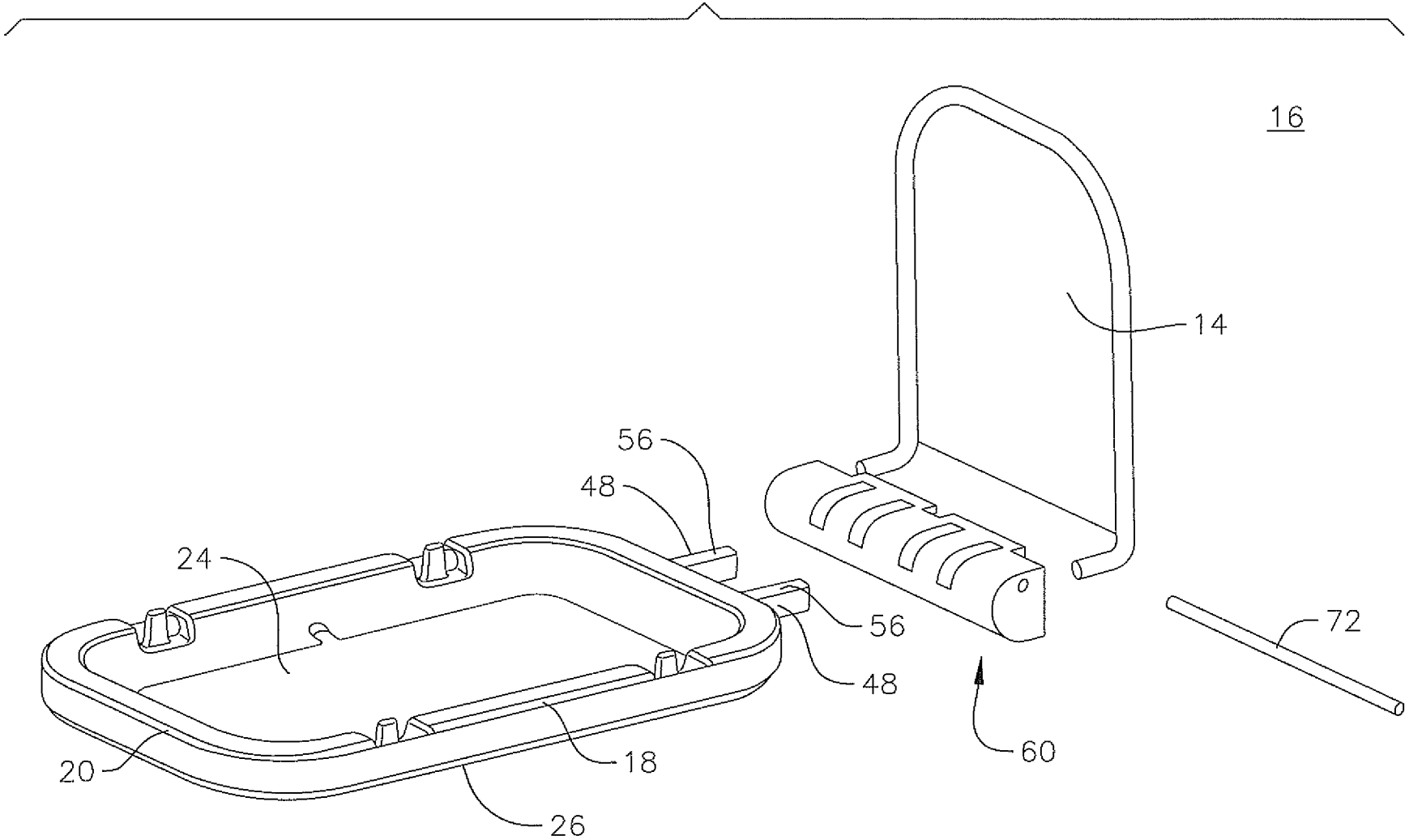
FIG. 4 is an example embodiment exploded view of a baby changing station with a vertical bed.
Figure 5:
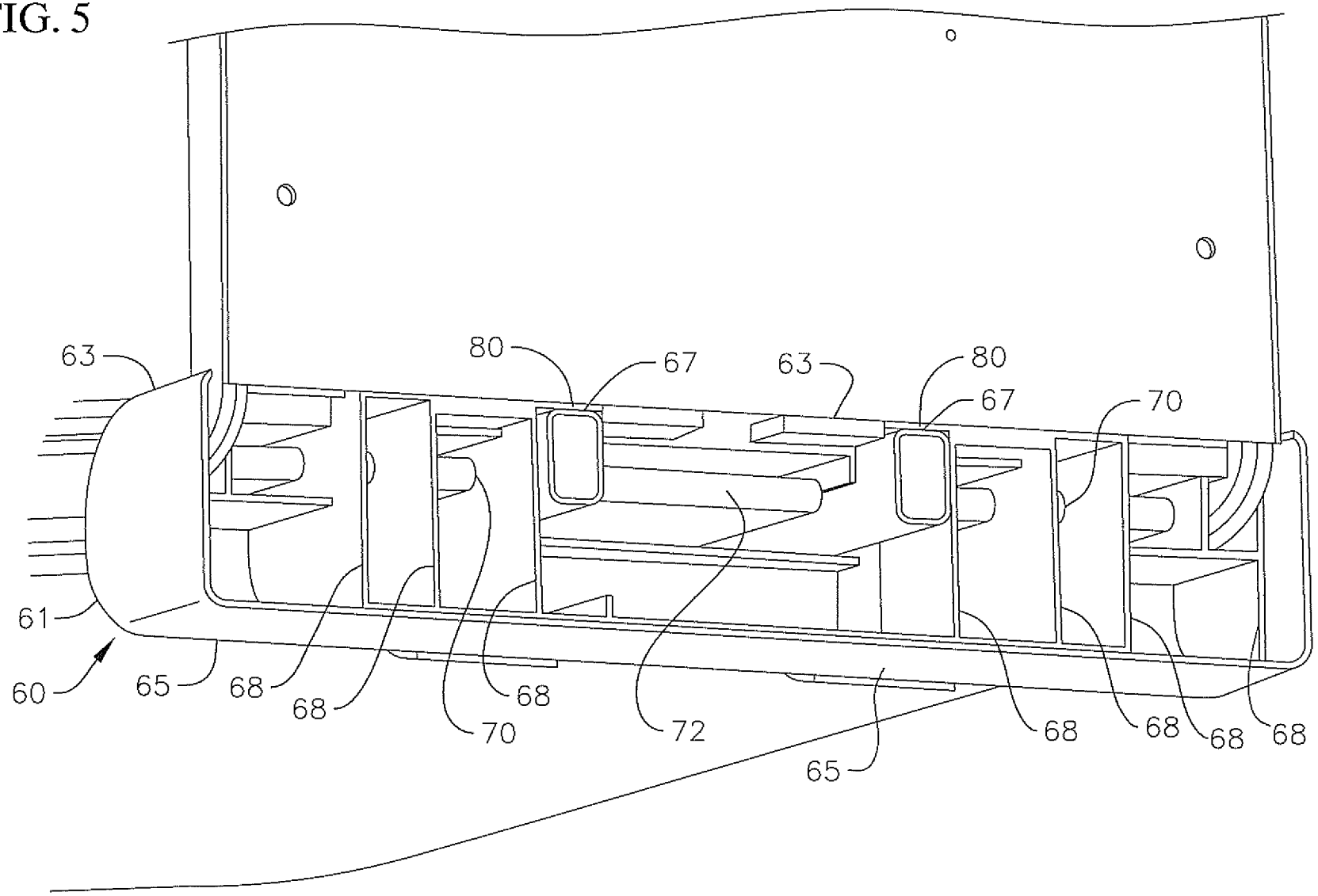
FIG. 5 is a rear perspective view of a mounting section of a wall mount of an example embodiment baby changing station.

The wall mount 14 includes a mounting section 60 onto which hingeably connect to the frame and thus the bed (FIGS. 1, 4, and 5). The mounting section includes a front wall 61 interconnecting an upper wall 63 and a lower wall 65. In an example embodiment, the mounting section has four slots defined through the front wall, two inner slots 62A, 62B and two outer slots 64A, 64B. The inner slots are designed to receive the two transversely extending portions 48 of the first and second frame members when a bed is vertically mounted, and the two external slots are defined to receive the two transversely extending portions from the first and second frame members when the bed is horizontally mounted. In another example embodiment, the transverse portions 48 of the first and second frame members are such that they would fit in the same slots whether the bed in mounted in a horizontal or vertical position. In such case, only two slots may be required to be formed in the mounting section of the wall mount.

Figure 6A:
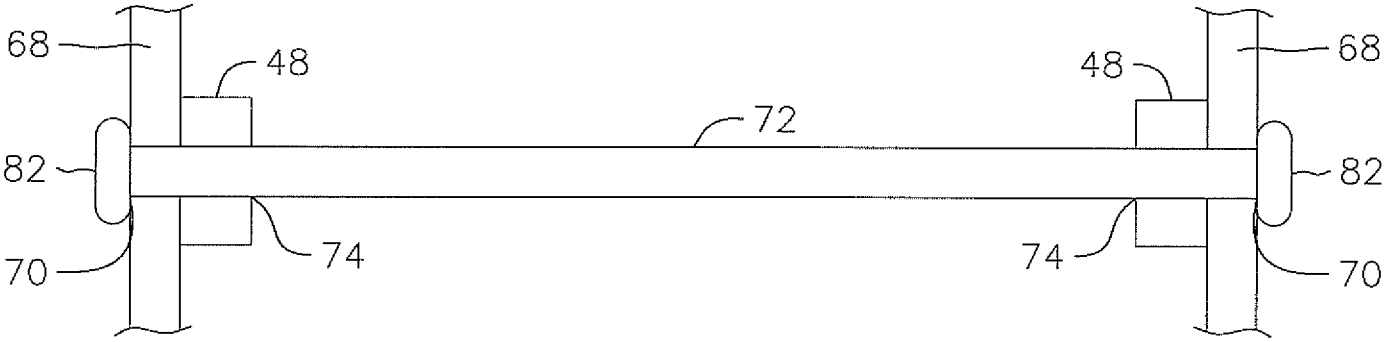
FIGS. 6A and 6B are schematic views of a coupling pin mounted in the mounting section of a wall mount of an example embodiment baby changing stations.
Figure 6B:
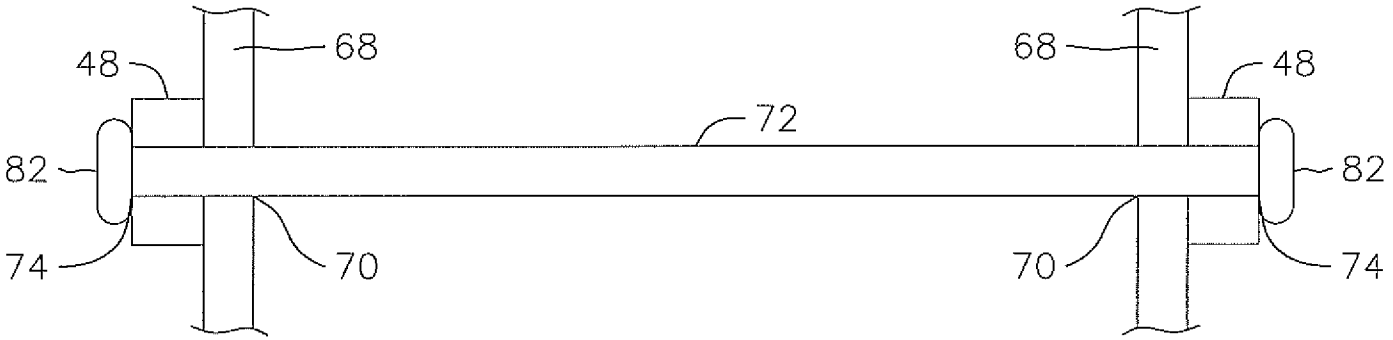

In an example embodiment, the mounting section includes at least two vertical walls 68 at least one, one for each slot (FIG. 5). The walls extend between the upper wall 63 and the lower wall 65 of the mounting section. Each vertical wall has an opening 70 for receiving a pin 72 therethrough (FIGS. 5, 6A and 6B). Each of the transversely extending portions 48 of the first and second frame members also include an opening 74 to receive the pin 72. The pin is inserted through the vertical walls, as well as through the openings formed from the transversely extending members. In the example embodiment shown in FIG. 5, the pin penetrates eight vertical walls. However, as for example shown in FIGS. 6A and 6B, the pin 72 may penetrate two vertical walls 68. The pin is locked in place by end caps 82. In an example embodiment, each end cap is mounted to an end of the pin. In an example embodiment, the caps are held in place by friction. In other example embodiments, the end caps are threaded to the ends of the pin. In this regard, the pin connects the frame to the wall mount providing for a pivotal connection. Thus, the frame as well as the bed can rotate relative to the pin and relative to the wall mount.

In other example embodiments, the end caps may be connected to the pin ends using other known methods. In one example embodiment, the end caps may be placed on the ends of the pin adjacent to the vertical wall 68, as for example shown in FIG. 6A, such that each vertical wall 68 is sandwiched between an end cap 82 and a transversely extending portion 48 of a frame. By being immediately adjacent to the vertical walls 68, the caps prevent or limit side movement of the pin 72. In another example embodiment as shown in FIG. 6B, the end caps are placed adjacent the transversely extending portions of the frame 48 such that the frame transversely extending portions 48 are each sandwiched between an end cap 82 and a vertical wall 68. By having the end caps immediately adjacent to the frame transversely extending portions 48, the end caps limit or alleviate side movement of the pin 72.

An inner surface 67 of the upper wall 63 of the mounting section 60 defines stop(s) 80. In other example embodiments, the stops 80 may be separate walls or structures (e.g. pads) attached to the inner surface 67. The transversely extending portions of the frame engages such stops to stop the rotation of the bed at the unfolded horizontal position. In other example embodiments, the stops may be separate members.

Although relative terms such as "outer," "inner," "upper," "lower," and similar terms have been used herein to describe a spatial relationship of one element to another, it is understood that these terms are intended to encompass different orientations of the various elements and components of the invention in addition to the orientation depicted in the figures.

According to example embodiments, a baby changing station may be provided having a wall mount and a single bed along with two sets first and second frame members and one third frame members. The baby changing station may be mounted with the bed in the vertical or the horizontal position. In other example embodiments, the baby changing station may be provided with two third frame members. One for interconnecting the first and second frame members when mounting the bed in the horizontal position and one for interconnecting the first and second frame members when mounting the bed in the vertical position.

What is claimed is:

1. A baby changing station comprising:

a mounting section for mounting to wall;

a bed;

a first frame comprising a first section for pivotably coupling the bed to the mounting section in a horizontal position; and a second frame comprising a first section for pivotably coupling the bed to the mounting section in a vertical position, wherein the first frame first section has a different shape than the second frame first section, wherein the bed comprises a first surface defining a bed for receiving a baby opposite a second surface and a peripheral surface extending from the first surface to the second surface, wherein the peripheral surface comprises a depression, wherein said first frame is received in the depression when mounting the bed in the horizontal position, and wherein said second frame is received in the depression when mounting the bed in the vertical position.

2. The baby changing station of claim 1, wherein each of the first and second frames further comprises, a second section and a third section.

3. The baby changing station of claim 2, wherein each frame first section is identical to said frame's second section.

4. The baby changing station of claim 2, wherein the third section of the first and second frames is the same third section.

5. The baby changing station of claim 2, wherein each frame first and second sections comprise a portion for pivotably coupling with the mounting section.

6. The baby changing station as recited in claim 5, wherein the mounting section comprises a first slot for receiving the first frame first section portion, and a second slot for receiving the first frame second section portion.

7. The baby changing station as recited in claim 5, wherein the mounting section comprises a first slot for receiving the second frame first section portion, and a second slot for receiving the second frame second section portion.

8. The baby changing station as recited in claim 7, wherein the mounting section comprises a third slot for receiving the first frame first section portion, and a fourth slot for receiving the first frame second section portion.

9. The baby changing station as recited in claim 5, wherein the mounting section comprises first and second vertical walls, wherein when the first frame mounts the bed to the mounting section, the first frame first section portion is adjacent the first vertical wall and the first frame second section portion is adjacent the second vertical wall, wherein a pin penetrates each of said first frame first and second section portions and said first and second vertical walls, wherein said first frame with bed is pivotable about said pin.

10. The baby changing station as recited in claim 9, wherein when the first frame mounts the bed to the mounting section, each of said first and second section portions and said first and second vertical walls comprise an opening penetrated by said pin, and wherein a first end cap is coupled to a first end of the pin and a second end cap is coupled to a second end of the pin opposite the first end, wherein each a cap has a dimension greater than a dimension of at least two of said openings.

11. The baby changing station as recited in claim 5, wherein the mounting section comprises first and second vertical walls, wherein when the second frame mounts the bed to the mounting section, the second frame first section portion is adjacent the first vertical wall and the second frame second section portion is adjacent the second vertical wall, wherein a pin penetrates each of said second frame first and second section portions and said first and second vertical walls, wherein said second frame with bed is pivotable about said pin.

12. The baby changing station as recited in claim 11, wherein when the second frame mounts the bed to the mounting section, each of said first and second section portions and said first and second vertical walls comprise an opening penetrated by said pin, and wherein a first end cap is coupled to a first end of the pin and a second end cap is coupled to a second end of the pin opposite the first end, wherein each a cap has a dimension greater than a dimension of at least two of said openings.

13. The baby changing station as recited in claim 5, wherein the mounting section comprises a first, second, third and fourth vertical wall, wherein when the bed is pivotably mounted to the mounting section in the horizontal position, the first frame first section portion is adjacent the first vertical and the first frame second section portion is adjacent the second wall, wherein a pin penetrates each of said first frame first and second section portions and said first and second vertical walls, wherein said first frame with bed is pivotable about said pin, and wherein when the bed is pivotably mounted to the mounting section in the vertical position, the second frame first section portion is adjacent the third vertical and the second frame second section portion is adjacent the fourth wall, wherein a pin penetrates each of said second frame first and second section portions and said third and fourth vertical walls, wherein said second frame with bed is pivotable about said pin.

14. The baby changing station as recited in claim 13, wherein each of said first, second, third and fourth vertical walls comprises an opening penetrated by said pin, and wherein a first end cap is coupled to a first end of the pin and a second end cap is coupled to a second end of the pin opposite the first end, wherein each a cap has a dimension greater than a dimension of at least two of said openings.

15. The baby changing station as recited in claim 5, wherein the mounting section comprises an upper wall, wherein the first section portion and the second section portion of each of said first and second frames when mounted on said mounting section directly or indirectly engage said upper wall to stop pivoting of the bed relative to the mounting section.

16. The baby changing station as recited in claim 15, wherein the first section portion for coupling with the mounting section and the second section portion for coupling with the mounting section of each of said first and second frames when mounted on said mounting section engages a structure connected to the upper wall to stop pivoting of the bed relative to the mounting section.

17. The baby changing station as recited in claim 15, wherein the first section portion for coupling with the mounting section and the second section portion for coupling with the mounting section of each of said first and second frames when mounted on said mounting section directly engages said upper wall to stop pivoting of the bed relative to the mounting section.

18. The baby changing station as recited in claim 1, wherein the mounting section comprises an upper wall, wherein the upper wall serves as a stop for stopping pivoting of the bed relative to the mounting section.

19. A baby changing station comprising:

a mounting section for mounting to wall;

a bed for supporting a baby, the bed comprising a first surface opposite a second surface and a peripheral surface extending from the first surface to the second surface;

a first frame for surrounding at least a portion of the peripheral surface at a location between the first and second surface, the first frame comprising a first section for pivotably coupling the bed to the mounting section in a horizontal position, a second frame having a different shape than the first frame for surrounding at least a portion of the peripheral surface at a location between the first and second surfaces, the second frame comprising a first section for pivotably coupling the bed to the mounting section in a vertical position, wherein said bed is pivotably couplable to said mounting section with only one of said first and second frames for supporting the baby.

20. The baby changing station of claim 19, wherein each of the first and second frames is for engaging the peripheral surface.

21. The baby changing station of claim 19, wherein each of the first and second frames is for being connected to the peripheral surface.

22. The baby changing station of claim 19, wherein each of the first and second frames further comprises a second section, wherein each frame first and second sections comprise a portion for pivotably coupling with the mounting section.

23. The baby changing station of claim 1, wherein the depression defines a channel in cross-section.

24. The baby changing station of claim 1, wherein the depression defines an L-shape as cross-section.

25. The baby changing station of claim 1, wherein said first frame first section has a different shape than said second frame first section when viewed along an axis generally perpendicular to a plane extending between the first and second surfaces of the bed and though the peripheral surface of the bed when said each first and second frame first sections is used for pivotably coupling the bed to the mounting section.

26. The baby changing station of claim 19, wherein said first frame has different shape than said second frame when viewed along an axis generally perpendicular to a plane extending between the first and second surfaces of the bed and though the peripheral surface of the bed when said each first and second frames is used for pivotably coupling the bed to the mounting section.

27. The baby changing station as recited in claim 26, wherein the first frame is couplable to the mounting section at two spaced apart locations, and wherein the second frame is couplable to the mounting section at two spaced apart locations.

28. The baby changing station as recited in claim 19, wherein the first frame is couplable to the mounting section at two spaced apart locations, and wherein the second frame is couplable to the mounting section at two spaced apart locations.

* * * * *